US007168284B2

(12) United States Patent
Shiokawa

(10) Patent No.: US 7,168,284 B2
(45) Date of Patent: Jan. 30, 2007

(54) METHOD AND APPARATUS FOR PRODUCING HOLLOW RACK BAR AND MANDREL USED FOR RACK BAR PRODUCTION

(75) Inventor: Seiji Shiokawa, Mishima (JP)

(73) Assignees: Minako Matsuoka, Tokyo (JP); Hiroshisa Shiokawa, Tokyo (JP); Akimasa Shiokawa, Tokyo (JP)

( * ) Notice: Subject to any disclaimer, the term of this patent is extended or adjusted under 35 U.S.C. 154(b) by 0 days.

(21) Appl. No.: 11/235,137

(22) Filed: Sep. 27, 2005

(65) Prior Publication Data

US 2006/0016238 A1 Jan. 26, 2006

(51) Int. Cl.
*B21D 39/08* (2006.01)

(52) U.S. Cl. ..... 72/370.06; 72/370.21; 29/893.34

(58) Field of Classification Search ..... 72/370.21, 72/370.01, 370.04, 370.06, 370.07, 393, 72/398, 381, 383; 29/893.34
See application file for complete search history.

(56) References Cited

U.S. PATENT DOCUMENTS 4,598,451 A * 7/1986 Ohki ..... 29/893.3
6,289,710 B1 * 9/2001 Ozeki ..... 72/370.04
6,317,979 B1 * 11/2001 Yamawaki ..... 29/893.34
6,442,992 B2 * 9/2002 Tsubouchi et al. ..... 72/370.21
6,494,073 B2 * 12/2002 Oka et al. ..... 72/356
6,575,009 B2 * 6/2003 Shiokawa ..... 72/370.06
6,718,813 B2 * 4/2004 Yasuda et al. ..... 72/370.04
2005/0072002 A1 * 4/2005 Kubota ..... 29/893.34

* cited by examiner

*Primary Examiner*—Lowell A. Larson
*Assistant Examiner*—Teresa M. Bonk
(74) *Attorney, Agent, or Firm*—Ditthavong & Mori, P.C.

(57) ABSTRACT

A system for forging a rack bar from a blank pipe. A blank pipe 1 is held between dies 2 and 3. Stockers 7L and 7R are arranged on respective sides of the die set. In the stockers 7L and 7R, left-handed shuttles 6$L_1$, 6$L_2$, 6$L_3$, . . . 6$L_n$ and right-handed shuttles 6$R_1$, 6$R_2$, 6$R_3$ . . . 6$R_n$ are stored. First, a left-handed presser rod 5L inserts the shuttles 6$L_1$ to the blank pipe from the left-handed stocker 7L. Then, a right-handed presser rod 5R inserts the shuttles 6$R_1$ to the blank pipe from the right-handed stocker 7R, causing the shuttles 6$L_1$ to be entrained and returned to the left-handed stocker 7L. Vertical shift movement is alternately executed between the left-handed and right-handed stockers 7L and 7R, so that a shuttle of step-likely increased working height is selected for executing a working process.

10 Claims, 6 Drawing Sheets

METHOD AND APPARATUS FOR PRODUCING HOLLOW RACK BAR AND MANDREL USED FOR RACK BAR PRODUCTION

FIELD OF THE INVENTION

1. Field of the Invention

The present invention relates to method and apparatus for producing hollow rack bar and mandrel used for rack bar production. Such a rack bar is used for a power steering device in an automobile, et al.

2. Description of Related Art

A rack bar used for a power steering device in an automobile has conventionally been machined from a solid bar of a rounded cross-sectional shape. However, from a viewpoint of a reduction in weight, a method has recently been proposed for producing a hollow rack bar from a pipe shaped blank by a forging process. In addition, it is a recent trend of a power steering apparatus, which is changed to an electrically operated type from a hydraulically operated type. In relation with such a trend, an attention is focused to a VGR (variable gear ratio) type of rack bar, wherein a pitch (spacing) and a pitch angle are non-uniform as compared with a standard type of rack bar wherein a pitch as well as pitch ration are fixed and unchanged. In such a rack bar of VGR type, a specialized machining process is needed, resulting in an increase in a production cost. Thus, a transferal forging system from a pipe shaped blank has recently been employed. Japanese Examined Patent Publication No. 3-5892 (U.S. Pat. No. 6,575,009) assigned to the same applicant discloses a rack bar production system employing such a transferal forging system from a pipe. In this patent, the formation of the rack bar, a hot forging and cold forging are combined. Namely, a pipe shaped blank is subjected to a pressing in a hot forging metal die, so that a flattening of the top surface is carried out. Then, a mandrel is inserted into a cavity of the pipe shaped blank under a pressure. The mandrel is provided with an operating head portion of a taper shape, which is engaged with the flattened portion of the blank pipe, thereby generating an outwardly directed plastic flow of the material at the flattened portion toward the toothed portions of the die. As a result, linear toothed portions, the shape of which corresponds to those of the toothed portions of the die, are formed on the flattened portion of the pipe under a transferring principle, thereby obtaining a rack bar. In the prior art, a stocker of vertical shift type or turret (rotating) type for mandrels of different operating heights is provided. A shifting operation or rotating operation is done in the stocker, so that a consecutive selection of a mandrel of step-likely increased operating height, which is inserted to the pipe shaped blank, is obtained, in a manner that a progressive working is realized. In more detail, in the '009 patent, a hydraulic linear driving device is provided for obtaining linear reciprocating movement of a mandrel from the mandrel stockers. The mandrel is of a highly elongated one, which is comprised of a working head and an integrated elongated rod integrally extended from the working head, which allows the working head to be inserted to the blank. This construction of the mandrel may cause it production cost to be high. Furthermore, a periodical exchange due to the wear is essential, which causes the running cost to be also high. Furthermore, in the shifting device, a vertical or rotating shifting operation of mandrels of increased size as well as weight is required, which makes the shifting device to be of a large size, thereby enhancing the cost of the device itself.

SUMMARY OF THE INVENTION

An object of the present invention aims to combat the above mentioned difficulties in the prior art and, more particularly, to obtain an increased cost reduction not only in a view point of a part exchange cost but also in a view point of an equipment cost.

According to one aspect of the present invention, a method is provided for producing a hollow rack bar, said method comprising the steps of:

providing a die forming therein with toothed portions;

providing a short-sized working member and an elongated presser member separated from said working member;

closing said die so that the hollow blank is held by said die;

inserting, under a pressure, said working member into a cavity in said hollow blank by cooperating said working member with said elongated presser member, so that an outwardly directed flow of the material of the blank toward the toothed portion of said die is obtained, thereby forming a rack bar.

According to another aspect of the present invention, a die apparatus is provided for producing a hollow rack bar comprising:

a die forming therein with toothed portions, said die being for holding a tubular shaped blank;

a short-sized working member, and;

an elongated presser member separated from said short-sized working member, said presser member cooperating with said short-sized working member, so that the latter is inserted to the cavity of the blank, so that an outwardly directed flow of the material of the blank toward the toothed portion of said die is obtained, thereby forming a rack bar.

The separate construction in the present invention makes it possible that a single presser member is commonly used between a plurality of short-sized working member (shuttles) for different working stages, resulting in a reduced cost for a rack bar formation, when compared with the prior art where a plurality of long sized mandrel for different working stages are employed. Namely, in the rack bar formation, a large force is generated, which make a part to be subjected to abrasion, resulting in the part to be changed. In the present invention, only exchange in the short sized working member of a relatively reduced cost is enough. Contrary to this, in the prior art, an occurrence of a abrasion makes it to be needed that an entire mandrel of increased cost is exchanged. Thus, the present invention using the shuttle type short-sized working member makes a running cost to be reduced over the prior art where a long sized mandrel is used. Furthermore, in the present invention, the short sized working members (shuttles) are cooperated with a presser rod for executing a rack bar formation, thereby keeping a desired quality of the products over those obtained by the prior art where long sized mandrels are employed. In this regard, an advantage will be explained with reference to a case where the present is employed for production of a rack bar for a steering mechanism of an automobile. A rack bar is typically produced from a blank pipe under left-handed six steps and right-handed six steps, i.e., totally twelve working stages (steps). In a prior art system, twelve long sized mandrels of a length of 960 mm would be needed. Contrary to this, in the present invention, shuttles of a length can be reduced to those of a length of 60 mm, although a left-handed and a left-handed commonly used two presser rods of a length of 900 mm are needed. A production cost will now be compared between the prior art and the present invention. A cost of a working head portion of a length of 60 mm is 40,000 yens and a cost of a presser rod portion of a length of 900 mm is 200,000 yens. Therefore, in the prior art, the total initial cost of twelve mandrels of length of 960 mm would be equal to (40,000+200,000)×12=2,880,000 yen. Contrary to this, in the present invention, the total initial cost of twelve shuttles and two presser rods are 40,000×12+200,000×2=880,000 yen. A service life of a working head part is estimated such that it can be used for a production of 100,000 parts. Furthermore, assuming that a production of 500,000 rack bars per year is continued for 10 years. In this case, in the prior art, total running cost would be (5,000,000×10/100,000)×2,880,000=144,000,000. Contrary to this, in the present invention, total running cost would be (500,000×10/100,000)×480,000=24,000,000. As a result, the present invention can obtain one sixth reduction of the running cost over the prior art.

In the present invention, a blank pipe as a work piece has a circular cross-sectional shape. The blank pipe is held between an upper die having inner toothed portions and a lower die having a semi-circular cross-sectional shape. The portion of the blank pipe, on which toothed portions are formed, is subjected to a diameter reduction of a value about 1 mm in comparison with the remaining portion of the pipe and is flattened in a manner that a substantial semi-circular shape is obtained. A short-sized working member (shuttle) of substantially semi-circular cross-sectional shape and having stepped head portions is inserted to the inner diameter of the blank pipe. The shuttle is, at the portion with no diameter reduction, freely rotatable. However, the free rotational movement of the shuttle allows the semi-circular cross-sectional shape of the shuttle to be finally aligned with that of the cavity of the work, thereby proceeding the working of the blank pipe by the toothed portions of the shuttle.

Preferably, the long-sized presser rod is connected to the shuttle in a manner that a free rotating movement of the shuttle is prevented with respect to the presser rod. In this construction, an insertion of the shuttle member to the blank pipe is always done at a desired orientation of the shuttle. As a result, any end-to-end contact is prevented from being occurred, when the shuttle is inserted to the portion of the blank pipe of the semi-circular cross-sectional shape, which allows the working (rack forging) to be smoothly executed.

Preferably, a plurality of shuttles having progressively changed working heights are stored in stockers located on both sides of the die for holding a blank pipe. The stocker is subjected to a shift movement, so that a shuttle of step-likely increased operating height is selected from the stocker and is inserted into a work piece (blank pipe), resulting in a step by step working of the work piece of desired number of working stages. Furthermore, a selection of shuttle is done alternately between the stocker on one side of the die set and the stocker on the other side, thereby obtaining symmetrical flow of metal to the die, resulting in an increased precision of a rack bar as a product. Preferably, the stocker is constructed by holders for shuttles and springs for resiliently urging the shuttles in place in the respective holders.

In the present invention, the stocker of a reduced size as well as a reduce weight can be used due to the fact the shuttles stored in the stocker are of reduced length. When executing the shuttle changing operation, a reduced pitch and an increased speed of the vertical shifting movement of the stocker are obtained. Thus, a rack bar production of an increased efficiency is obtained, while preventing any vibration problem from being occurred, which would occur if a long sized mandrel in the prior art as long as 950 mm is used.

In the present invention, for forging a rack bar from a blank pipe, a mandrel is constructed by a shuttle shaped (short length) working member and an elongated (long sized) presser member detachable from said short-sized working member but cooperating with the shuttle shaped working member. The shuttle shaped working members of a number corresponding to that of working stages are needed. However, a presser member is commonly used between the shuttle shaped working members, resulting in a reduction in the part cost as well as a running cost.

BRIEF EXPLANATION OF ATTACHED DRAWINGS

EXPLANATION OF PREFERRED EMBODIMENTS

Figure 1A:
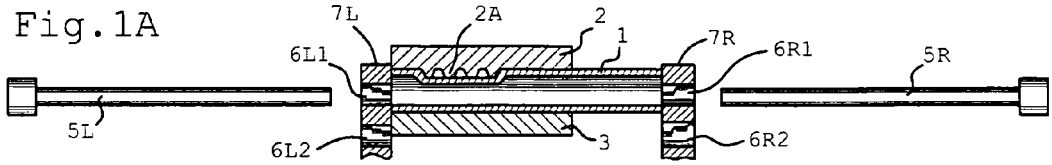
FIGS. 1A to 1G illustrate schematically a series of working stages for forming a hollow rack bar according to the present invention.

FIGS. 1A to 1G illustrate, schematically, a series of processes of a rack bar production according to the present invention. In the drawings, a reference numeral 1 denotes a steel pipe as a hollow blank, which is arranged between split dies 2 and 3 constructing a die set. As shown in FIGS. 2A and 2B, the lower die 3 functioning as a clamping die is, at its transverse cross-section, a inner surface 3A of a semi-circular shape, on which the pipe 1 is rested. The upper die 2 functions as a clamping die as well as an embedded type holder for toothed portions and has toothed portions 2A (tooth profile) spaced along the length of the die 2. Due to the execution of "transferal forging", a linear toothed shape corresponding to that of the toothed shape of the upper die 2 is formed on or transferred to an upper side of the pipe 1, resulting in a production of a rack bar. In FIG. 2A, the upper and lower dies 2 and 3 are combined with each other, so that the pipe 1 is contacted with the toothed portions 2A at the inner surface of the upper die 2. As a result, the pipe 1 is, at its portion contacting with the upper die 2, collapsed in a manner that slightly inwardly recessed flattened upper surface 1A is obtained. As will be fully described later, a shuttle member as a short-sized operating head 6L or 6R (FIGS. 1A to 1G) is forcedly inserted into the cavity of the partly flattened pipe 1 by means of an elongated presser rod 5L or 5R, which causes the material at the flattened portion 1A (FIG. 2A) to be subjected to a plastic flow toward the upper die 2, resulting in a formation or transferring of a toothed shape on the upper surface 1A of the pipe 1, which toothed shape corresponds to the toothed portions 2A at the inner surface of the upper die 2. The blank pipe 1 is subjected to a tooth shape formation under transferal forging principle at a portion of a length, for example, of about 250 mm from the left-handed end of the pipe 1 in FIGS. 1A to 1G. Therefore, the pipe 1 is at a portion of a length, for example, of about 500 mm rightward from the toothed portion forms a completely rounded cross-sectional shape. The portion of the rounded cross-sectional shape is, as shown in FIGS. 1A to 1G, partly and freely protruded from the right hand end of the dies 2 and 3 for a length, for example, of about 300 mm. As will be fully described later, the shuttles 6L and 6R have a length of roughly about 60 mm and are provided with a plurality of operating heads, as will be described later. The presser rods 5L and 5R have, simply, a circular cross-sectional shape of a fixed diameter, which is smaller than the dimension of the shuttles 6L and 6R, so that any slippage does not occur even under the effect of pressing force as generated by the execution of an expanding forming operation. These shuttles 6L and 6R of varied operating sizes are stored in a left-handed and right-handed outside stockers 7L and 7R, respectively, in such a manner that a vertical or rotary shifting of the shuttles 6L and 6R is occurred in the stockers 7L and 7R, respectively. A pair of the presser rods 5L and 5R is arranged at positions outwardly from the respective stockers 7L and 7R. These presser rods 5L and 5R are purely subjected to a horizontal reciprocating movement by means of respective hydraulic mechanisms without being subjected any vertically shifted movement.

Figure 2A:
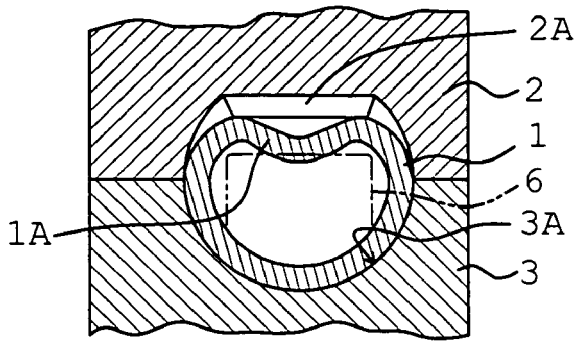
FIG. 2A is a cross sectional view of a die set, which illustrates a condition of a blank pipe, which is flattened by combined upper and lower dies.
Figure 3:
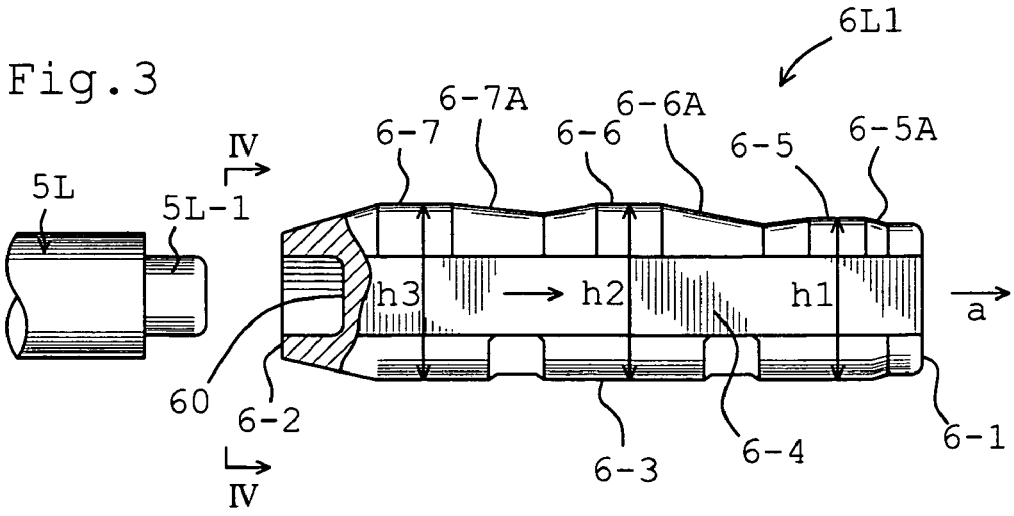
FIG. 3 is a side view of a left-handed shuttle for effecting a working stage of odd numbered.
Figure 4:
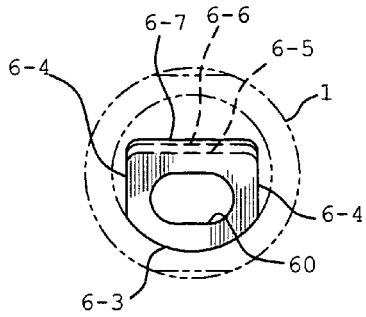
FIG. 4 is a view of a shuttle taken along a line IV—IV of FIG. 3.

Next, a construction of the shuttles 6L and 6R will be explained. FIG. 3 illustrates a shuttle $\mathbf{6}L_1$, which is inserted into a blank pipe 1 in the right-handed direction as shown in FIG. 1A just after the completion of the flattening of the pipe 1 by a die clamping. Namely, in the direction of the insertion, the shuttle $\mathbf{6}L_1$ has a right-handed end 6-1, where an introduction of the shuttle $\mathbf{6}L_1$ to the blank pipe is started and a left-handed end 6-2, where a withdrawal of the shuttle $\mathbf{6}L_1$ from the blank pipe is started. At the withdrawal side, the shuttle $\mathbf{6}L_1$ is formed with a recess 60, to which a leading end 5L-1 of the left-handed presser rod 5L is engaged, so that an insertion under a pressure of the shuttle $\mathbf{6}L_1$ into a cavity of a blank pipe is executed. The shuttle $\mathbf{6}L_1$ is longitudinally reciprocated in the cavity of the blank pipe 1, while the shuttle $\mathbf{6}L_1$ keeps, at its bottom surface 6-3, a close contacted with the rounded inner surface of the blank pipe, as shown in FIG. 4. The shuttle has a pair of opposed flat surfaces 6-4, which are slightly spaced from the opposed rounded inner surface of the blank pipe 1. The shuttle has top flat surfaces, which construct tri-stepped operating head portions 6-5, 6-6 and 6-7 of values of height $h_1$, $h_2$ and $h_3$, respectively. Forwardly from the operating head portions 6-5, 6-6 and 6-7 in the direction of the insertion of the shuttle to the blank pipe as shown by an arrow a in FIG. 3, the shuttle is formed with tapered guiding portions 6-5A, 6-6A and 6-7A, respectively, so that a smooth movement of the shuttle is obtained irrespective of the flow resistance of the material during the execution of the rack formation. Between the operating head portions 6-5, 6-6 and 6-7, the shuttle forms slightly recessed portions for storage of lubricant fed during the forged formation of rack under press insertion, thereby providing a desired lubricity to the shuttle. When the steel blank pipe 1 is held initially between the dies 2 and 3, the upper surface 1A of the pipe is flattened while being centrally recessed, i.e., the pipe is formed to a quasi-semicircular cross-sectional shape, as already explained with reference to FIG. 2A. In this condition, an introduction of the shuttle $\mathbf{6}L_1$, to the blank pipe 1 is commenced. Namely, the shuttle $\mathbf{6}L_1$ is, from its leading end 6-1, introduced into the cavity of the blank pipe 1. Then, via from its leading end 6-1, to the blank pipe 1 is commenced. After guided by the first tapered guiding surface 6-5A, the first operating or enlarging head 6-5 of an operating height of $h_1$ is engaged with the flattened portion 1A of the pipe 1, which causes the material of the pipe to be expanded or displaced (plastically flown) toward the toothed portion 2A at the inner surface of the upper die 2. In accordance with a progress of the introduction of the shuttle to the blank pipe, after guided by the tapered surfaces 6-6A, a metal flow by the second operating head 6-6 of the height of $h_2$ and after guided by the tapered surfaces 6-7A, a metal flow by the third operating head 6-7 of the height of $h_3$ are sequentially operated. As a result, a smooth step-like progress of the forging operation is obtained.

Figure 5:
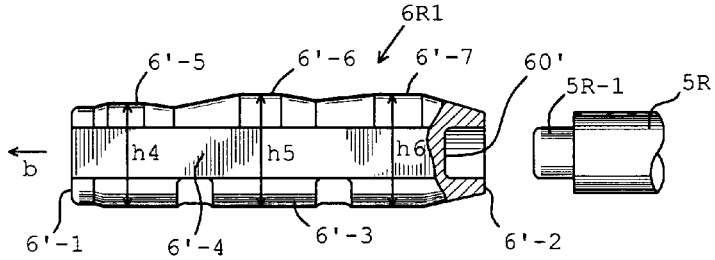
FIG. 5 is a side view of a right-handed shuttle for effecting a working stage of even numbered.

FIG. 5 illustrates a construction of a shuttle $\mathbf{6}R_1$, which is inserted into a blank pipe 1 in the left-handed direction as shown by an arrow b for the second stage processing when a withdrawal of the shuttle $\mathbf{6}L_1$ in the left-handed direction is done due to the completion of the first stage working by the shuttle $\mathbf{6}L_1$. Namely, in the direction of the insertion, the shuttle $\mathbf{6}R_1$ has a left-handed end 6'-1, where an introduction of the shuttle $\mathbf{6}R_1$ to the blank pipe is started and a right-handed end 6'-2, where a withdrawal of the shuttle $\mathbf{6}R_1$ from the blank pipe is started. At the withdrawal side, the shuttle $\mathbf{6}R_1$ is formed with a recess 60', to which a leading end 5R-1 of the right-handed presser rod 5R is engaged, so that an insertion under a pressure of the shuttle $\mathbf{6}R_1$ into a cavity of a blank pipe is executed. As similar to the shuttle $\mathbf{6}L_1$ in FIG. 3, the shuttle $\mathbf{6}R_1$ in FIG. 5 is formed with three step working heads 6'-5, 6'-6 and 6'-7, of which heights are step-likely increased as illustrated by $h_4$, $h_5$ and $h_6$, respectively, in the direction of the insertion of the shuttle $\mathbf{6}R_1$ as shown by the arrow b. The height $h_4$ of the first operating (enlarging) head 6'-5 of the shuttle $\mathbf{6}R_1$ in the direction of the insertion as shown by the arrow b is decided in accordance with the height $h_3$ of the third working head 6-7 of the shuttle $\mathbf{6}R_1$, i.e., the highest value of the working head height during the preceding working stage in the opposite insertion direction. Namely, after the withdrawal of the inserted shuttle $\mathbf{6}L_1$, some degree of a spring back (shrinkage of the worked portion) is occurred in the blank 1. In other words, the height of height $h_4$ of the first operating head 6'-5 of the shuttle $\mathbf{6}R_1$ is such that a desired expansion amount is obtained irrespective of inevitable occurrence of the spring back as generated after the completion of the preceding working in the opposite insertion direction. In short, as the insertion of the shuttle $\mathbf{6}R_1$ is progressed in the left-handed direction in FIG. 5, the blank is sequentially engaged with heads 6'-5, 6'-6 and 6'-7, so that a smooth, further plastic flow of the material of the blank 1 toward the toothed portions 2A of the die is obtained.

A shuttle used for the following third stage working is, as similar to that shown in FIG. 3, inserted in the right-handed direction. But, the values of the heights of its working heads are such that a further increased expansion is done when compared with that obtained at the preceding second stage working. At the following fourth stage working, a shuttle having further increased heights of operating heads is used and is inserted in the left-handed direction as similar to the shuttle for the second stage shown in FIG. 5. In the similar way, a desired number of total working stages such as twelve working stages are obtained, resulting in a final completion of the rack forming process. FIG. 2B schematically illustrates a positional relationship of a shuttle 6" for the final working stage to the blank pipe 1. The shuttle 6" has a height, which is enough for causing the material to be fully expanded or flown to the toothed portions 2A of the die, so that a forging of toothed portions corresponding to those 2A of the die on the upper portion of the pipe 1, i.e., a transfer type rack formation is completed.

The recesses 60 and 60' formed in the shuttles for preventing any free rotating movement between the shuttles and the respective presser rods 5L and 5R are effective for obtaining a smooth movement of the shuttles. In case where recesses 60 and 60' are not provided, the shuttles effect mere end-to-end contact with the presser rods 5L and 5R, which allows a relative free angular relative movement to be generated between contacted parts. Therefore, a situation may be arisen where an introduction of a shuttle to a portion the blank pipe of rounded cross-sectional shape is done while the shuttle is an angularly displaced from a desired angular position and a continued insertion of the shuttle may cause the latter to be blocked when the shuttle is engaged with the portion of the blank pipe of the semicircular cross-sectional shape. Thus, a certain mechanism is essential for obtaining a corrective, relative angular movement in a manner that the operating head portions of the shuttle is finally engaged with the flattened portion 1A of the blank pipe, thereby obtaining a desired forged operation.

Next, a process for forming a rack according to the present invention will be explained, wherein shuttles are reciprocated in the cavity of a blank pipe 1 held between the dies 2 and 3. As shown in FIGS. 1A to 1G, the stockers 7L and 7R are arranged on the respective sides of a blank pipe 1 as a work piece. Arranged in the stockers 7L and 7R are shuttles of step-likely increased values of operating height. In FIGS. 1A to 1G, the shuttles on the left-handed side are designated by 6L followed by shift numbers and the shuttles on the right-handed side are designated by reference number 6R followed by shift numbers in a similar way. Namely, in the left-handed side stocker 7L, a shuttle of the first shift position is designated by $\mathbf{6}L_1$, a shuttle for the second shift position by $\mathbf{6}L_2$ and a shuttle for the third shift position by $\mathbf{6}L_3$. In the similar way, in the right-handed side stocker 7R, a shuttle for the first shift position is designated by $\mathbf{6}R_1$, a shuttle for the second shift position by $\mathbf{6}R_2$ and a shuttle for the third shift position by $\mathbf{6}R_3$.

FIG. 1A illustrates a preparatory condition, where a blank pipe 1 is held by the dies 2 and 3. The left-handed presser rod 5L is opposed to the shuttle $\mathbf{6}L_1$ (FIG. 3) for the first stage working and the right-handed presser rod 5R is opposed to the shuttle $\mathbf{6}R_1$ (FIG. 3) for the second stage working.

In order to effect a first stage working, a movement of the left-handed presser rod 5L in the right-handed direction is started, which causes its leading end 5L-1 (FIG. 3) to be engaged with the recess 60 of the shuttle $\mathbf{6}L_1$. The continued movement of the presser rod 5L in the right-handed direction in FIG. 1A is continued, so that the shuttle $\mathbf{6}L_1$ is, first, moved out from the stocker 7L and, then, is inserted into the cavity of the blank pipe 1. Due to the insertion of the into the cavity of the blank pipe 1, the first stage working by the operating heads 6-5, 6-6 and 6-7 of successively increased values of height is done as already explained with reference to FIG. 3. As the end of the right-handed stroke of the left-handed presser rod 5L, the shuttle $\mathbf{6}L_1$ is completely passed the toothed portions 2A of the upper die 2 as shown in FIG. 1B and is stopped at a position in the pipe 1, which is a preparatory position for the following second stage working.

Figure 1B:
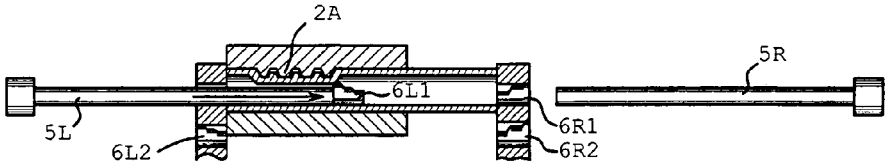

The second stage working is started by a movement of the right-handed presser rod 5R in the left-handed direction in FIG. 1B. Namely, during the left-handed movement, the presser rod 5R is, first, at its leading end 5R-1, engaged with the recess 60' as shown in FIG. 5. By the continued movement of the presser rod 5R in the left handed direction in FIG. 1A, the shuttle $\mathbf{6}R_1$ is moved out from the right-handed stocker 7R and, then, the shuttle $\mathbf{6}R_1$ is inserted into the cavity of the blank pipe 1 from its right-handed end. Then, the shuttle $\mathbf{6}R_1$ is made end-to-end contact with the shuttle $\mathbf{6}L_1$. Then, the shuttle $\mathbf{6}L_1$ is moved in the left-handed direction, due to the fact that the left-handed presser rod 5L is in a retracted position as shown FIG. 1C. Simultaneously with the movement of the shuttle $\mathbf{6}L_1$ toward the stocker 7L, the second stage working of the blank pipe 1 is done by the shuttle $\mathbf{6}R_1$, which has the operating heads 6'-5, 6'-6 and 6'-7 as shown in FIG. 5. Thus, the metal is further plastically flown toward the toothed portions 2A of the die. Finally, as shown in FIG. 1C, the shuttle $\mathbf{6}L_1$, which is still under an end-to-end contact with the right-handed shuttle $\mathbf{6}R_1$, is stored in the stocker 7L while the shuttle $\mathbf{6}R_1$ is engaged out of the toothed portions 2A of the die, i.e., the second stage working of the blank pipe 1 by the shuttle $\mathbf{6}R_1$ is finished.

Figure 1C:
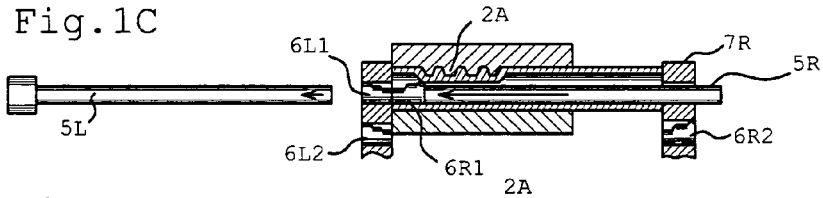
Figure 1D:
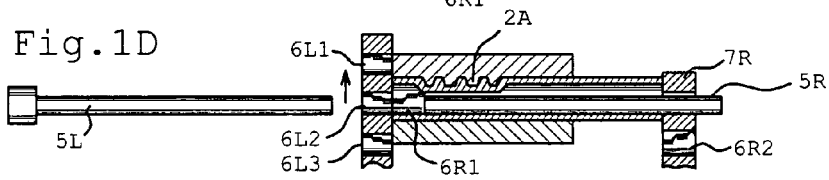

In the condition as shown in FIG. 1C, one step upward shift of the left-handed stocker 7L is obtained in a manner that the second step shuttle $\mathbf{6}L_2$ is aligned with the left-handed presser rod 5L as shown in FIG. 1D. In this condition as shown in FIG. 1D, the presser rod 5L is moved in the right-handed direction, so that a third stage working of the blank pipe 1 by means of the working heads of the shuttle $\mathbf{6}L_2$ is executed. The shuttle $\mathbf{6}R_1$ executed the preceding second stage working is entrained by the shuttle $\mathbf{6}L_2$ and is moved back in the right-handed direction toward the stocker 7R. The right-handed movement of the left-handed presser rod 5L, i.e., the entrained movement of the shuttle $\mathbf{6}L_2$ is ceased when a condition as shown in FIG. 1E is obtained, where the shuttle $\mathbf{6}R_1$ is stored in the designated shift position in the right-handed stocker 7R.

Figure 1E:
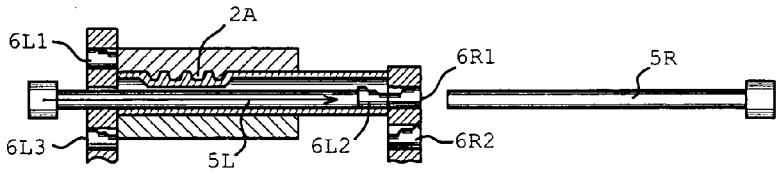
Figure 1F:
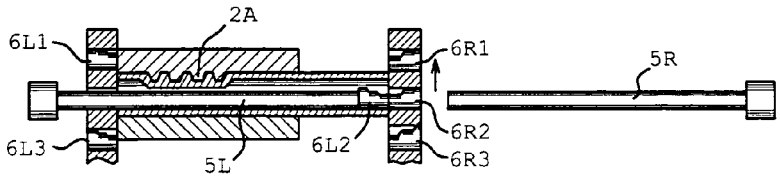
Figure 1G:
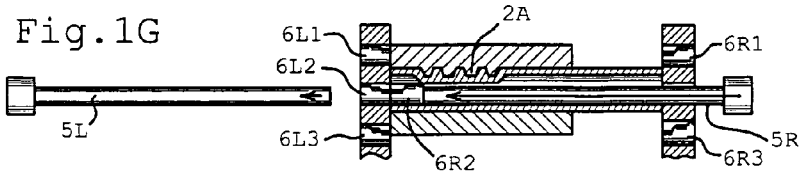
Figure 2B:
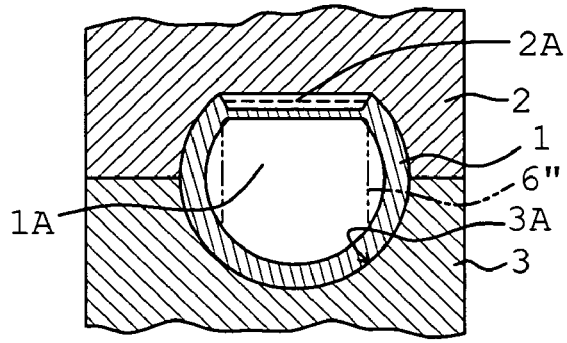
FIG. 2B is similar to FIG. 2A but illustrate a condition that the rack formation process is completed.

In the condition shown in FIG. 1E, an upward one step shift of the right-handed stocker 7R is obtained in a manner that the shuttle $\mathbf{6}R_2$ is aligned with the right-handed presser rod 5R as shown in FIG. 1F. In this condition, the presser rod 5R is moved in the left-handed direction, so that a fourth stage working of the blank pipe 1 by means of the working heads of the shuttle $\mathbf{6}R_2$ is done. The shuttle $\mathbf{6}L_2$ executed the preceding third stage working is entrained by the shuttle $\mathbf{6}R_2$ and is moved back in the left-handed direction toward the designated position of stocker 7L. The left-handed movement of the right-handed presser rod 5R, i.e., the entrained movement of the shuttle $\mathbf{6}R_2$ is ceased when a condition as shown in FIG. 1G is obtained, where the shuttle $\mathbf{6}L_2$ is stored in the designated position in the left-handed stocker 7L.

In short, according to the present invention, an alternate insertion is done between the shuttles $\mathbf{6}L_1$, $\mathbf{6}L_2$, $\mathbf{6}L_3$, . . . and $\mathbf{6}L_n$ in the left-handed stocker 7L and the shuttles $\mathbf{6}R_1$, $\mathbf{6}R_2$, $\mathbf{6}R_3$, . . . and $\mathbf{6}R_n$ in the right-handed stocker 7R. A selection of a shuttle for working from the respective stocker is such that the operating height is progressively or gradually increased. In order to do this, the stocker 7L and 7R are subjected to an upward step-by-step shift movement. A shuttle used at the preceding working stage is entrained by the movement of the shuttle effecting the instant working stage and returned to a designated position of the respective stocker. In this way, a desired number of working stages, such as 12 is obtained, resulting in a reliable and highly qualified formation of a rack bar under a transfer forging basis.

Figure 6:
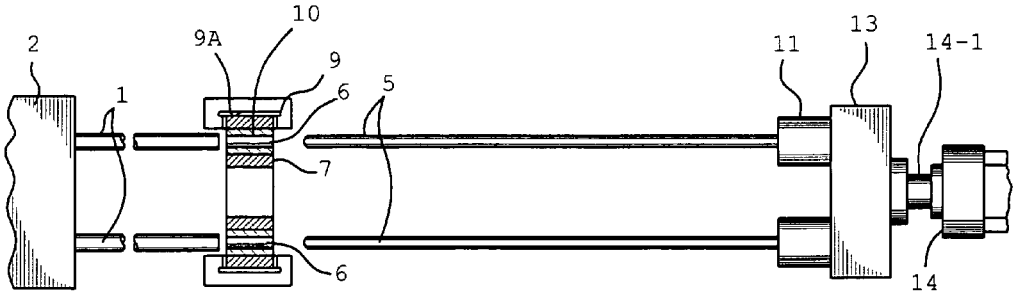
FIG. 6 is a schematic plan view of a rack bar forging system, wherein a production of two rack bars is simultaneously effected.
Figure 7:
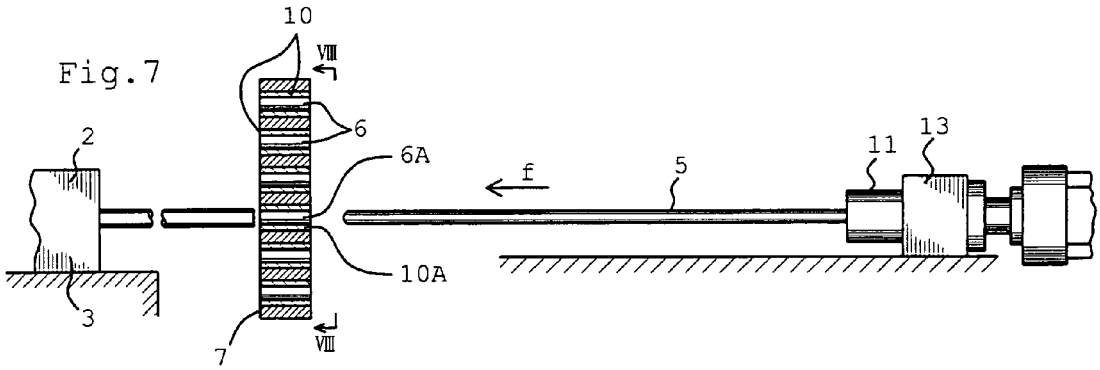
FIG. 7 is a schematic side view of a rack bar forging system in FIG. 6.
Figure 8:
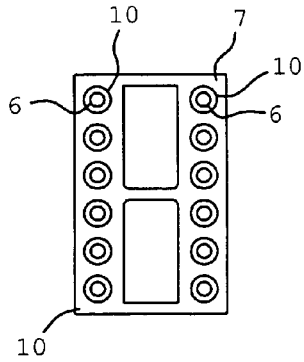
FIG. 8 is a view of the system taken along a line VIII—VIII of FIG. 7.

FIGS. 6 to 8 schematically illustrates a schematic construction of a stocker 7. In this case, the stocker 7 corresponds to the right-handed stocker 7R shown in FIG. 1. For the left-handed stocker 7L, a similar structure as that shown in FIGS. 6 to 8 is employed. The stocker 7 is formed with a pair of upright stands 9 having opposed guide grooves 9A, to which the stocker 7 is vertically slidably mounted. In this embodiment of the stocker 7, two pipes 1 as work pieces are simultaneously worked. Namely, as shown in FIGS. 6 and 7, two pipes 1 are, under a parallel condition, held between the upper and lower dies 2 and 3 and two presser rods 5 insert simultaneously two shuttles 6 to respective pipes 1 via a stocker 7. The shuttles 6 for working the respective pipes are stored in respective shuttle holders 10. As shown in FIG. 8, a plurality of vertically spaced pairs of horizontally spaced holders 10 for left-handed and right-handed shuttles are provided, the number of which pair corresponds to the number of shift (six in the embodiment in FIG. 8).

In FIGS. 6 and 7, the pair of horizontally spaced presser rods 5 are, at their ends spaced from the corresponding stocker 7, held by a holder 11, which is carried by a cross frame 13 moved or operated by a hydraulic cylinder 14. The hydraulic cylinder 14 has a piston rod 14-1 having an end connected to the cross bar 13 unit is cylinder frame 13. A well-known mechanism is provided for controlling a direction of flow of pressure liquid to the cylinder 14 in a manner that a desired movement of the presser rods 5 is obtained.

A drive mechanism such as a hydraulic mechanism is provided for obtaining a vertical shift movement of the stocker 7. In the operation of the mechanism, a working is started from the shuttles 6 located at the top of the stocker 7 by causing the respective shuttle holders 10 to be aligned with the pipe 1 as a work piece. Namely, the presser rod 5 is operated so that the shuttle 10 is moved out of the respective holder 10 in the stocker 7 and is inserted to the inner cavity of the pipe 1. An upward shift (selection) movement of the stocker followed by a working by released shuttles from respective holders for the working is done under a step-by step basis. In FIG. 7, the stocker 7 is in a vertically shifted position where a shuttle 6A in the fourth position from the top is aligned with the blank pipe 1 as a work piece as well as the presser rod 5. A forward movement of the presser rod 5 in the left-handed direction as shown by an arrow f causes the shuttle 6A to be released from the respective holder 10A and to be inserted to the blank pipe 1.

Figure 9:
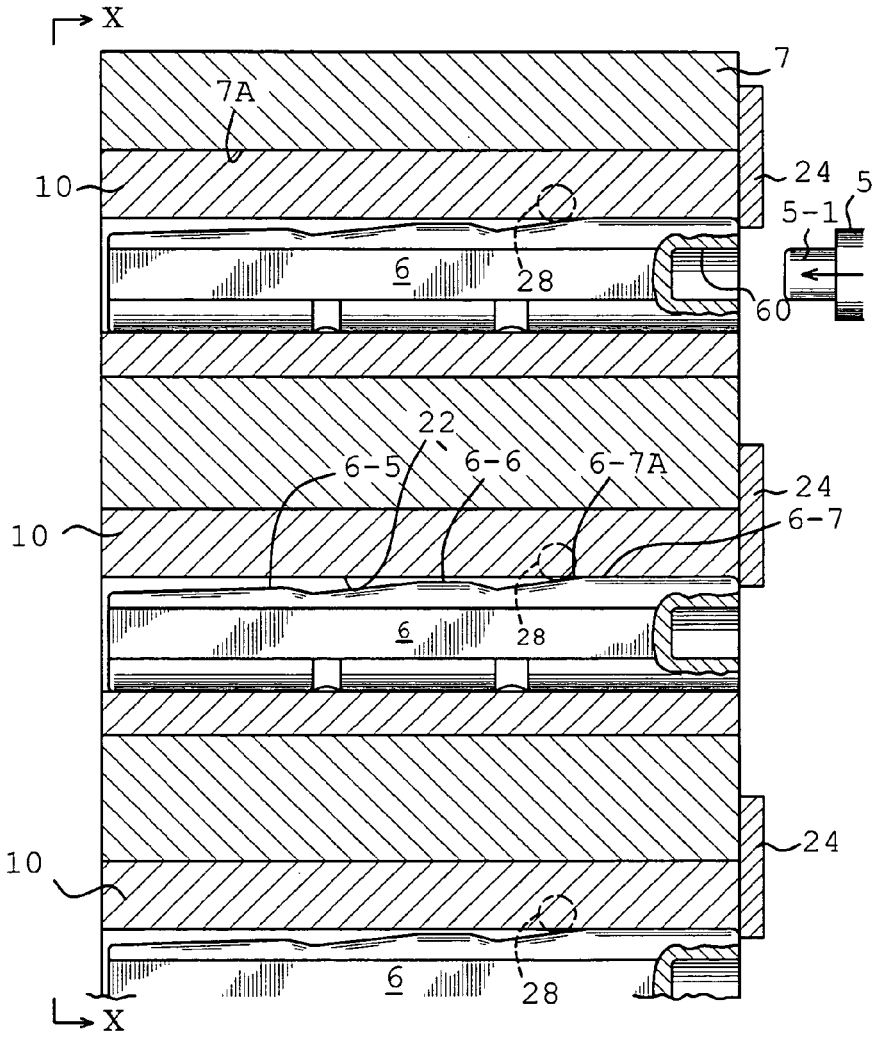
FIG. 9 illustrates a vertical cross-sectional view of a stocker, which illustrates how shuttles are held in the left-handed stocker.
Figure 10:
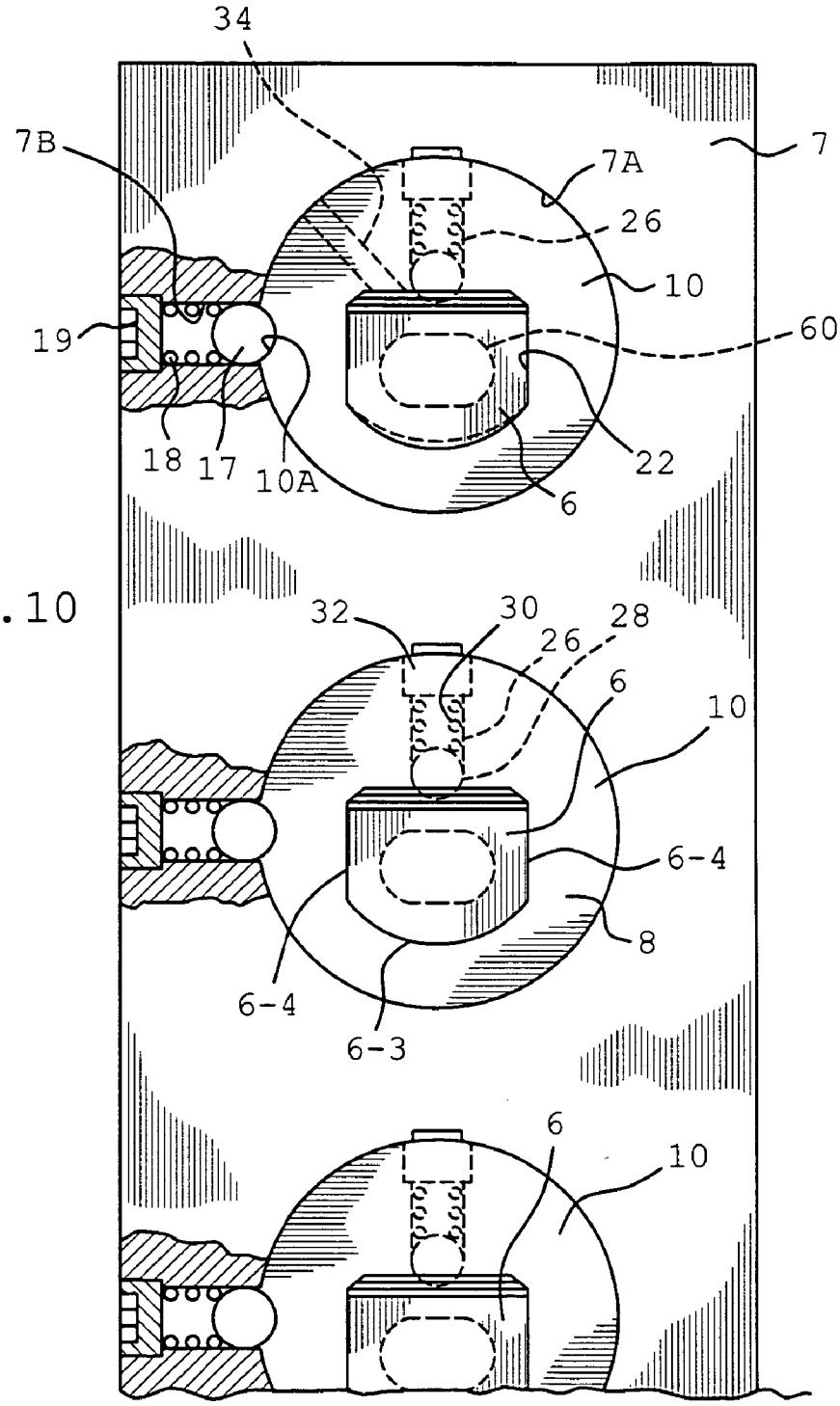
FIG. 10 is a view taken along lines X—X in FIG. 9.

FIGS. 9 and 10 illustrate a construction for holding a shuttle 6 by a shuttle holder 10 in a stocker 7. The shuttle holder 10 forms a sleeve shape, which is inserted to a tubular cavity 7A of the stocker 7 and is locked in a predetermined position in the stocker 7 by means of a ball shaped notch member 17. Namely, the shuttle holder 10 forms a semi-spherical recess 10A, with which the ball shaped notch member 17 is engaged under a preset load as obtained by a spring 18 stored in a bore 7B in the stocker 7. A set screw 19 is screwed to the bore 7B, which allows the spring load by the spring 18 to be adjusted. As shown in FIG. 9, the shuttle holder 10 is formed with an axially extending tubular cavity 22 therethrough, which has a cross-sectional shape, which corresponds to that of the shuttle 6 as shown in FIG. 10. Namely, the shuttle 6 is, at its curved bottom surface 6-3 and the flat side surfaces 6-4, closely and slidably engaged with the opposed surface of the shuttle cavity 22. Furthermore, the shuttle 6 is, at its operating head portion 6-7A of the maximum height, closely and slidably engaged with the opposed upper flat surface of the shuttle cavity 22. A stopper plate 24 is fixed to an end surface of the stocker 7 by any suitable means and has a bottom end extending slightly out of an inner edge of the bore 22. Therefore, an engagement of the shuttle with the stopper 24 prevent the shuttle 6 from being moved further to the right-handed direction toward the presser rod 5. As shown in FIG. 10, the shuttle holder 10 is formed with a vertical bore 26 extending radially therethrough, in which a ball shaped locking member 28 is stored. In the position of the shuttle 6 where the latter is in contact with the stopper 24, i.e., the right most position of the shuttle 6, the ball shaped locking member 28 is, as shown in FIG. 8, engaged with a tapered guiding surface 6-7A of the shuttle 6 adjacent the operating head 6-7 under the set force as obtained by the spring 30, so that the shuttle 6 is held in a predetermined position in the corresponding shuttle holder 10 under a preset spring load. As shown in FIG. 10, a set screw 32 is in contact with the spring 30, so that a desired adjustment of the spring force (load) as generated by the spring 30 is made possible. The shuttle holder 10 is further formed with a hole 34 for feeding lubricating oil.

In FIG. 9, the presser rod 5 is moved forwardly as shown by an arrow for starting the rack bar formation. A continued movement causes the leading end 5-1 of the presser rod 5 to be fitted with the recess 60 of a shuttle 60. As a result, the shuttle 60 is moved in the same direction (left-handed direction in FIG. 9), while the ball 28 engaged with the tapered surface 6-7A of the shuttle 60 is displaced upwardly against the force of the set spring 30. A continuation of such a movement of the shuttle 60 in the left-handed direction of FIG. 9 finally causes the shuttle 60 to be released from the shuttle holder 10 and is inserted to a cavity of a blank pipe as a work piece as already described in detail with reference to FIGS. 1A to 1G and FIGS. 6 to 8.

The invention claimed is:

1. A method for producing a hollow rack bar comprising the steps of:

providing a die forming therein with toothed portions;

providing a shuttle shaped working member and an elongated presser member separated from said working member;

closing said die so that the hollow blank is held by said die, and;

inserting, under a pressure, said working member into a cavity in said hollow blank by cooperating said working member with said elongated presser member, so that an outwardly directed plastic flow of the material of the blank toward the toothed portion of said die is obtained, thereby forming a rack bar.

2. A method for producing a hollow rack bar comprising the steps of:

providing a die forming therein with toothed portions;

providing a plurality of shuttle shaped working members of variable stepped operating heights and an elongated presser member separated from said working member;

closing said die so that the hollow blank is held by said die;

selecting a shuttle shaped working member from the plurality of shuttle shaped working members in a manner that the one of gradually increased operating heights is selected;

inserting, under a pressure, said selected shuttle shaped working member into a cavity in said hollow blank by cooperating said working member with said elongated presser member, so that an outwardly directed plastic flow of the material of the blank toward the toothed portion of said die is obtained, and;

repeating said selecting and inserting steps until a working by the finally selected shuttle shaped working member is finished, thereby completing multi staged forging of a rack bar.

3. A die apparatus for producing a hollow rack bar comprising:

a die forming therein with toothed portions, said die being for holding a tubular shaped blank;

a working member of shuttle type, and;

an elongated presser member separated from said working member of shuttle type, said presser member cooperating with said working member, so that the latter is inserted to the cavity of the blank, resulting in an outwardly directed flow of the material of the blank toward the toothed portion of said die is obtained, thereby forming a rack bar.

4. A die apparatus according to claim 3, wherein a cooperation of said working member with said elongated presser member is such that they are prevented from being freely rotated with each other.

5. A die apparatus for producing a hollow rack bar comprising:

a die forming therein with toothed portions, said die being for holding a tubular shaped blank;

a set of shuttle shaped working members of variable stepped operating heights;

a stocker on at least one side of said die for storing said set of shuttle shaped working members in a manner that a desired one of the working members is selected, and;

an elongated presser member located on one side of said stocker remote from said die, said elongated presser member being cooperated with the selected working member in a manner that the latter is inserted to the cavity of the blank, so that an outwardly directed flow of the material of the blank toward the toothed portion of said die is obtained, thereby forming a rack bar.

6. A die apparatus according to claim 5, wherein said stocker has a plurality of holders for the working members of variable stepped operating heights, respectively and spring members for resiliently urging the working members in a manner that the working members are resiliently held at desired positions in the respective holders.

7. A die apparatus according to claim 6, wherein said holders are linearly spaced and wherein said stocker is subjected to a linear movement in a manner that a working member of a desired operating height is selected and is cooperated with the presser member in accordance with the progress of the rack bar forming stage.

8. A die apparatus for producing a hollow rack bar comprising:

a die forming therein with toothed portions, said die being for holding a tubular shaped blank;

a first set of shuttle shaped working members of variable stepped operating heights;

a second set of shuttle shaped working members of variable stepped operating heights;

a first stocker on one side of said die for storing said first set of shuttle shaped working members in a manner that a desired one of the working members in the first stocker is selected;

a second stocker on the other side of said die for storing said second set of shuttle shaped working members in a manner that a desired one of the working members in the second stocker is selected;

a first elongated presser member located on one side of said first stocker remote from said die, and;

a second elongated presser member located on one side of said second stocker remote from said die, said first and second elongated presser members cooperating with the selected one of the working members in the first and second stockers, respectively, in a manner that the selected working members are alternately inserted to the cavity of the blank, so that an outwardly directed flow of the material of the blank toward the toothed portion of said die is obtained, thereby forming a rack bar.

9. A mandrel device use together with a die having toothed portions and holding a hollow blank in a manner that the mandrel is, under a pressure, inserted to an inner cavity of the blank, so that the material of the blank is flown toward to toothed portions of the die, thereby forging a rack bar, wherein said mandrel comprises a shuttle shaped working member and an elongated presser member detachable from said shuttle shaped working member but cooperating therewith in a manner that the working member is linearly moved during the execution of a forging operation.

10. A mandrel device according to claim 9, wherein said shuttle member and said elongated presser member are shaped so that a formed connection therebetween is obtained thereby keeping a desired angular relationship.

* * * * *